United States Patent [19]

Tanaka

[11] Patent Number: 4,735,519

[45] Date of Patent: Apr. 5, 1988

[54] COLOR INK RIBBON

[75] Inventor: Masayuki Tanaka, Hiroshima, Japan

[73] Assignee: Mitsubishi Denki K.K., Tokyo, Japan

[21] Appl. No.: 861,890

[22] Filed: May 12, 1986

[30] Foreign Application Priority Data

May 16, 1985 [JP] Japan ..... 60-106316

[51] Int. Cl.[4] ..... B41J 33/10

[52] U.S. Cl. ..... 400/240.3; 400/208; 400/240.4

[58] Field of Search ..... 400/240, 240.3, 240.4, 400/82, 208, 235

[56] References Cited

U.S. PATENT DOCUMENTS

| | | | |
|---|---|---|---|
| 3,961,121 | 6/1976 | Warsager | 400/240.3 X |
| 4,542,997 | 9/1985 | Matsushima | 400/240.3 |
| 4,661,003 | 4/1987 | Okamori | 400/82 X |
| 4,669,899 | 6/1987 | Kawakami et al. | 400/208 X |

FOREIGN PATENT DOCUMENTS

| | | | |
|---|---|---|---|
| 1238935 | 4/1967 | Fed. Rep. of Germany | 400/240.3 |
| 11261 | 1/1984 | Japan | 400/240.4 |

*Primary Examiner*—Edgar S. Burr
*Assistant Examiner*—James R. McDaniel
*Attorney, Agent, or Firm*—Sughrue, Mion, Zinn, Macpeak & Seas

[57] ABSTRACT

A color ink ribbon in which one half of the width of the ribbon is utilized for the left-to-right (first) printing direction and the other half of the width is utilized for the right-to-left (second) printing direction, and in which the sequence of ink layers composed of at least three colors is the same for both printing directions, whereby the ribbon can be used for printing in both the forward and reverse directions without wasteful non-utilization of areas in either half of the ribbon.

4 Claims, 1 Drawing Sheet

FIG. 1
PRIOR ART
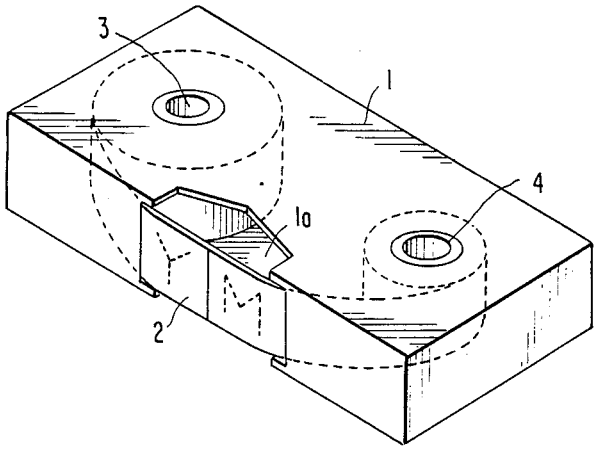
FIG. 2 PRIOR ART
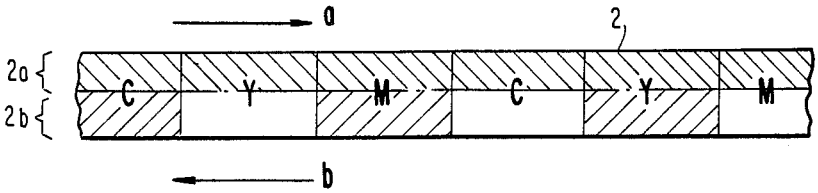
FIG. 3
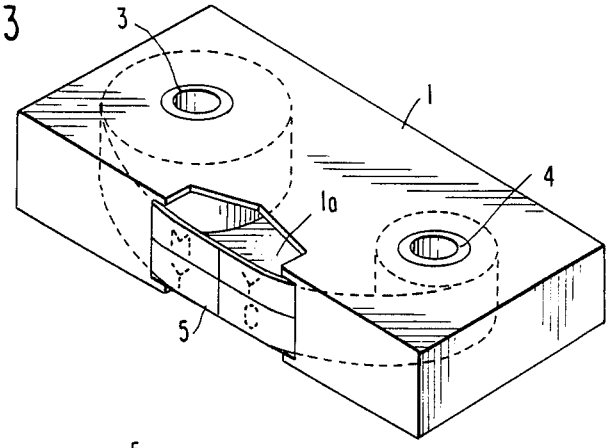
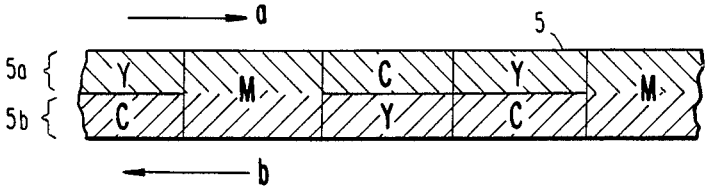
FIG. 4

COLOR INK RIBBON

BACKGROUND OF THE INVENTION

This invention relates to a color ink ribbon for use in color thermal serial printers and the like. A color ink ribbon of this kind is frequently replaced as a consumable item. It is a common practice, therefore, that the color ink ribbon be housed within a cartridge case for ease of replacement.

Since the cartridge, itself, represents a large portion of the price of the cartridge ribbon assembly, an attempt has been made to make the effective working area of a color ink ribbon as large as possible, as shown in FIGS. 1 and 2 and hereinafter explained.

FIG. 1 is a perspective view showing a color ink ribbon cartridge equipped with a conventional color ink ribbon, and FIG. 2 illustrates the color arrangement thereof. In FIG. 1, a cartridge case 1 contains a color ink ribbon 2 and has a window portion formed to accommodate the size of recording paper (not shown) utilized.

The cartridge case 1 is made of synthetic resin and is equipped with a feed capstan 3 for delivering the color ink ribbon 2 and a take-up capstan 4 for taking up the same, the two capstans being respectively and rotatably secured in the cartridge. The color ink ribbon 2 has a three-color ink layer unit, consisting of a sequence of yellow (Y), magenta (M), and cyan (C) layers, and the unit is repeated in sequence in one direction along the length of the ribbon. The color nk ribbon 2 also has a width sufficient to accommodate two longitudinal tracks or regions of units to permit the ribbon to be used in either direction or longitudinal movement, depending upon whether the cartridge case 1 is placed in a first or reversed position within the printer.

Arrows a and b, shown in FIG. 2, respectively indicate the left-to-right and right-to-left longitudinal printing directions of the color ink ribbon 2. The manner of use of the color ink ribbon 2 will now be explained with reference to FIG. 2. When the ink color layers Y, M and C are selected in this order, for example by the video signal from a personal computer or the like, in the left-to-right printing direction (a), one of the ribbon tracks, that is, the upper area (hatched portion 2*a*), is used continuously.

When the cartridge case 1 is reversed and the ink color layers Y, M and C are again selected in this order, for example by a similar video signal, in the right-to-left printing direction (b), the other of the ribbon tracks, that is, the lower area (hatched portion 2*b*), is then used continuously.

Although the conventional color ink ribbon 2 can be run in both longitudinal directions, there is a difference between the left-to-right printing direction (a) and the right-to-left printing direction (b) in the order of appearance of the individual ink layers of Y, M and C. More specifically, when the cartridge case is reversed to use the conventional color ink ribbon in the right-to-left direction (b), the ribbon areas without hatchings (the lower track 2*b* shown in FIG. 2) are not utilized, and, thus, ribbon is wastefully consumed, but these areas of the individual color layers cannot be used because of the requirement to maintain the fixed color sequence of Y, M and C.

As a result, the cost of running a thermal printer with the conventional ribbon is very high.

SUMMARY OF THE INVENTION

It is, therefore, an object of this invention to eliminate the shortcoming of the conventional color ink ribbon by providing a color ink ribbon in which each ink layer is fully utilized, thereby reducing unused tape areas to a minimum so that the ribbon is economically used.

This object is accomplished by providing an improved color ink ribbon comprising a first region or track used for the left-to-right printing direction, a second region or track used for the right-to-left printing direction, a first ink pattern on the first region or track and formed of at least a three-color ink layer unit which is repeated along the length of the ribbon in the left-to-right direction and which contains a fixed sequence of at least three longitudinally adjacent individual color layers, and a second ink pattern on the second region or track and formed of at least a three-color ink layer unit which is repeated along the length of the ribbon and which contains the same fixed sequence of color layers in the right-to-left direction of ribbon movement.

BRIEF DESCRIPTION OF THE DRAWINGS

FIG. 1 is a perspective view showing a color ink ribbon cartridge equipped with a conventional color ink ribbon;

FIG. 2 is a schematic representation illustrating the ink layer unit arrangement in the conventional color ink ribbon;

FIG. 3 is a perspective view showing a color ink ribbon cartridge equipped with a color ink ribbon in accordance with this invention; and FIG. 4 is a schematic representation illustrating the ink layer unit arrangement in the color ink ribbon in accordance with this invention.

DETAILED DESCRIPTION OF THE PREFERRED EMBODIMENT

In the embodiment of the invention as disclosed in FIG. 3 and FIG. 4, a color ink ribbon 5 is housed within a cartridge 1 and is provided with a three-color ink layer unit of yellow (Y), magenta (M) and cyan (C) and which is sequentially repeated in one direction. This color ink ribbon 5 has a first region 5*a* in the upper half of the whole width of the ribbon used for the left-to-right (first)printing direction and a second region 5*b* in the lower half for the right-to-left (second) printing direction. On the first region 5*a* of the color ink ribbon 5 is formed a first ink pattern in which each ink layer unit of adjacent Y, M and C is repeated in the left-to-right printing direction (arrow a). Similarly, a second ink pattern in which each ink layer unit of adjacent Y, M and C is repeated in the right-to-left printing direction (arrow b) on the second region of the color ink ribbon 5.

For the ink layer M where the first region 5*a* and the second region 5*b* have a common color, ink coating is applied as a whole while, for the ink layers Y and C, ink coating is separately applied to the upper and lower half areas, respectively. The manner of use of the color ink ribbon in accordance with the invention will now be described with reference to FIG. 4.

When the ink layers Y, M and C are selected in this order, for example by the video signal from a personal computer or the like, in the left-to-right printing direction, the ink layers Y, M and C in the first region 5*a* (hatched area) are used for printing in sequence.

When the cartridge case 1 is reversed and the ink layers Y, M and C are selected in this same order, for example by a similar video signal, in the right-to-left printing direction, the ink layers Y, M and C in the second region **5*b*** (hatched area) are used for printing in sequence.

Since the first ink pattern in the first region used for the left-to-right printing direction and the second ink pattern in the second region used for the right-to-left printing direction are identical, the order of appearance of the individual ink layers of Y, M and C for the left-to-right printing direction is identical to that for the right-to-left printing direction. Therefore, the ink layers of Y, M and C are fully utilized in both the upper and lower regions or tracks for both printing directions, without wasting some portions of one half of the ink layers (as occurs in the case of the conventional color ink ribbon), thereby providing a reduction in the running cost of thermal serial printers.

While the invention has been disclosed with reference to an embodiment in which monochrome printing is utilized, it will be understood that the ink layers of Y, M and C can also be used for multicolor printing by combining colors. The above mentioned ink layer unit may also be composed of more than three colors.

I claim:

1. A color ink ribbon comprising:

a. a first longitudinal printing region used for a first longitudinal printing direction;

b. a second longitudinal printing region used for a second longitudinal printing direction opposite to said first printing direction;

c. said first and second regions being parallel;

d. a first ink pattern on said first region and formed of a repeating series of longitudinally extending three-color ink layer units, each unit containing first, second and third color ink layers in a fixed sequence in said first direction; and e. a second ink pattern on said second region and formed of a repeating series of longitudinally extending three-color ink layer units each of which contains said color ink layers in said fixed sequence in said second direction;

f. each color layer in said first ink pattern being transversely aligned with a color layer in said second ink pattern so that all of the color ink layers in both said firtst region and said second region are respectively utilized in opposite printing directions; and wherein said fixed sequence is said first color layer, followed by said second color layer, followed by said third color layer, wherein the first color layers in said first region are transversely aligned with the third color layers in said second region, and vice versa, and wherein the second color layers in said first and second regions are transversely aligned with each other.

2. A color ink ribbon as set forth in claim 1, wherein said first region and said second region respectively occupy different halves of the ribbon in the transverse direction.

3. A color ink ribbon as set forth in claim 1, wherein all of said ink layers have the same longitudinal length.

4. A color ink ribbon as set forth in claim 1, wherein said first color is yellow, said second color is magenta, and said third color is cyan.

* * * * *